US005966096A

United States Patent [19]

Brachat

[11] Patent Number: 5,966,096

[45] Date of Patent: Oct. 12, 1999

[54] COMPACT PRINTED ANTENNA FOR RADIATION AT LOW ELEVATION

[75] Inventor: Patrice Brachat, Nice, France

[73] Assignee: France Telecom, Paris, France

[21] Appl. No.: 08/839,252

[22] Filed: Apr. 17, 1997

[30] Foreign Application Priority Data

Apr. 24, 1996 [FR] France ..... 96-05383

[51] Int. Cl.[6] ..... H01R 1/38

[52] U.S. Cl. ..... 343/700 MS; 343/767

[58] Field of Search ..... 343/700 MS, 769, 343/850, 767, 846, 768; H01R 1/38

[56] References Cited

U.S. PATENT DOCUMENTS

| | | | |
|---|---|---|---|
| 4,053,895 | 10/1977 | Malagisi | 343/700 |
| 4,089,003 | 5/1978 | Conroy | 343/700 |
| 4,529,987 | 7/1985 | Bhartia et al. | 343/700 |
| 4,987,421 | 1/1991 | Sunahara et al. | 343/700 MS |
| 5,124,713 | 6/1992 | Mayers et al. | 343/700 MS |
| 5,410,323 | 4/1995 | Kuroda | 343/700 |

FOREIGN PATENT DOCUMENTS

| | | |
|---|---|---|
| 0 270 209 A3 | 11/1986 | European Pat. Off. . |
| 2 664 749 A1 | 7/1990 | France . |

OTHER PUBLICATIONS

Patent Abstracts of Japan, vol. 14, No. 213 (E–0923), 7 Mai 1990 & JP–A–02 048803 (Yuuseishiyou Tsushin Sogo Kenkyusho), 19 Fevrier 1990.

Hiroyuki Arai et al., A Flat Energy Density Antenna System for Mobile Telephone, IEEE Transactions of Vehicular Technology, vol. 40, No. 2, 1 Mai 1991, pp. 483–486.

Khitrov, A Switched Mircostrip Antenna, Telecommunications and radio Engineering, vol. 47, No. 3 Mar. 1, 1992, pp. 76–79.

Vaughan, Two–Port Higher Mode Circular Microstrip Antennas, IEEE Transactions on Antennas and Propagation, vol. 36, No. 3, Mar. 1988, New York, pp. 309–321.

*Primary Examiner*—Robert H. Kim
*Assistant Examiner*—Layla G. Lauchman
*Attorney, Agent, or Firm*—Kinney & Lange, P.A.

[57] ABSTRACT

This invention relates to a flat printed antenna for transmission and/or reception of microwave signals of the type that includes particularly a plate of dielectric substrate an earth plane formed by a first conductor layer deposited on a first face of the plate of dielectric substrate, a radiating element (30) formed by a second conductor layer deposited on a second face of the plate of dielectric substrate, means of feeding the antenna This antenna has a fundamental mode, in which it generates a radiation pattern having a maximum in the direction perpendicular to the plane containing the radiating element, and at least one higher mode, in which it generates a radiation pattern with low elevation, According to the invention, the radiating element has at least one slot (31 to 34) allowing the control of the resonance frequency of a chosen higher mode.

19 Claims, 11 Drawing Sheets

COMPACT PRINTED ANTENNA FOR RADIATION AT LOW ELEVATION

BACKGROUND OF THE INVENTION

The field of the invention is that of flat printed antennae for the transmission and/or reception of microwave signals.

More precisely, the invention relates to a flat antenna producing maximum radiation at low elevations.

The antenna of the invention has numerous applications. It can, for example, be used in a network positioned on the roof of a particular vehicle so as to provide telecommunications via satellite. In effect, certain mobile stations, and particularly those linked to geostationary satellites in countries of medium or high latitude (Northern Europe for example) require flat antennae producing maximum radiation at low elevations.

At present, for reasons of the space occupied and for cost reasons, "patch" type printed antennae are used in mobile stations. In effect, these have the notable advantage of being flat and inexpensive.

In a general way, a printed antenna includes a dielectric substrate plate, an earth plane (constituted by a first conductor layer deposited on a first face of the dielectric substrate plate), a radiating element (constituted by a second conductor layer, deposited on a second face of the dielectric substrate plate) and means of feeding the antenna.

In their everyday operation, that is to say, when they are operating in their fundamental mode, these antennae generate a radiation pattern having a maximum in the direction perpendicular to the plane that contains the antenna. For this type of everyday operation, the length of the radiating element is very close to the half wavelength taking into account the permittivity of the dielectric substrate used.

In order to be able to generate radiation having a maximum for low elevations, that is to say in directions a long way from the perpendicular axis to the plane containing the antenna, the printed antennae must operate in a higher mode, the current distribution of which allows this type of radiation to be created.

The major problem rests in the fact that the higher modes that are of interest appear for frequencies that are relatively high in relation to those of the fundamental mode. This means that in order to be able to use this type of (higher) mode for the desired frequency band (close to that corresponding to the fundamental mode), the antenna must be overdimensioned to a very high degree.

This oversizing makes it quasi-impossible to integrate it into a network of radiating elements so as to obtain high gain antennae. This size problem is all the more crucial for a network having to generate radiation at low elevation, the radiating elements must be positioned very close to one another so as to avoid large network lobes which seriously reduce the gain of the antenna.

BRIEF SUMMARY OF THE INVENTION

In particular, the invention has the objective of getting around this major disadvantage of the state of the technology.

More precisely, one of the objectives of the present invention is to provide a printed antenna that allows one to obtain radiation at low elevations whilst taking up less space.

Equally, the invention has the objective of providing such an antenna which preserves all the advantages of printed antennae and particularly a low manufacturing cost.

These different objectives, as well as others that will appear in the following, are achieved according to the invention with the help of a flat printed antenna for transmission and/or reception of microwave signals of the type that includes particularly

- a plate of dielectric substrate
- an earth plane constituted by a first conductor layer deposited on a first face of said dielectric substrate plate,
- a radiating element constituted by a second conductor layer deposited on a second face of said dielectric substrate plate,
- means of feeding said antenna said antenna having a fundamental mode, in which it generates a radiation pattern having a maximum in the direction perpendicular to the plane containing the radiating element, and at least one higher mode, in which it generates a radiation pattern at low elevation, said antenna characterized in that said radiating element has at least one slot allowing the control of the resonance frequency of a chosen higher mode.

The chosen higher mode is that in which one wishes the to see antenna operate in such a way that maximum radiation is generated at low elevations.

Hence, for a given higher mode, the general principle of the invention consists of reducing the resonance frequency simply by producing slots in the radiating element, that is to say without modifying the overall space taken up by the antenna. To put it in other terms, for operation in the same higher mode, the printed antenna of the invention occupies a smaller space than a traditional printed antenna.

Advantageously, the slot(s) is(are) arranged approximately perpendicular to the current lines of said chosen higher mode.

In this way, the electric length of these current lines is increased and hence, the resonance frequency of the chosen higher mode is reduced.

In an advantageous way, the dimensions (length, width) of the slot(s) are determined using a calculation technique based on a method of finite elements.

Preferably, said feed means use a feeding technique belonging to the group including:

- feed by a coaxial probe;
- feed by coupling through a slit;
- feed by proximity coupling
- feed through a feed line in the plane of the radiating element.

Preferably, said radiating element is in the shape of a disc.

DETAILED DESCRIPTION OF THE PREFERRED EMBODIMENTS

In a first preferred embodiment of the invention, said chosen higher mode is the TM21 mode, the current lines of which form a pattern which is repeated in each quarter of said disc, said radiating element having four radial slots, spaced, two by two, at angles of about 90°, each of said slots being approximately perpendicular to the current lines in said quarters of the disc.

In a second preferred embodiment of the invention, said chosen higher mode is the TM01 mode, the currents of which are arranged radially, said radiating element having at least one circular slot, the slot or slots extending over at least a part of the circumference of a circle contained within said disc and having the same centre as it.

In an advantageous way, each slot works with means for disabling its effect, said antenna including means of activating/deactivating said disabling means.

Preferably, said means of disabling the effect of a slot include a diode linking the two edges of said slot.

In a first particular embodiment of the invention, said radiating element has a plurality of slots, said activating/deactivating means acting simultaneously on all the disabling means associated with said plurality of slots in a way that allows multimode operation so that:

- when all the disabling means are activated, the antenna operates in said fundamental mode,
- when all the disabling means are deactivated, the antenna operates in said chosen higher mode.

This multimode operation allows a large solid angle to be covered with a maximum of radiation. In effect, in fundamental mode, one has a maximum of radiation in the direction perpendicular to the plane containing the antenna, and in the chosen higher mode, one has a maximum of radiation at a low elevation.

In a second particular embodiment of the invention, said radiating element has a plurality of slots, said activation/deactivation means acting on a number, that is variable in time, of disabling means associated with said plurality of slots, in a way that permits multifrequency operation such that each distinct number of disabling means activated at a given instant corresponds to a particular resonance frequency of said chosen higher mode.

This allows multifrequency operation for one and the same type of higher mode.

The invention also relates to a two band antenna, characterized in that it includes two super-imposed antennae, called the lower and the upper antennae, of the type described above, the radiating element of said lower antenna forming the earth plane of said upper antenna.

The invention therefore relates to a flat printed antenna for transmission and/or reception of microwave signals.

Figure 1:
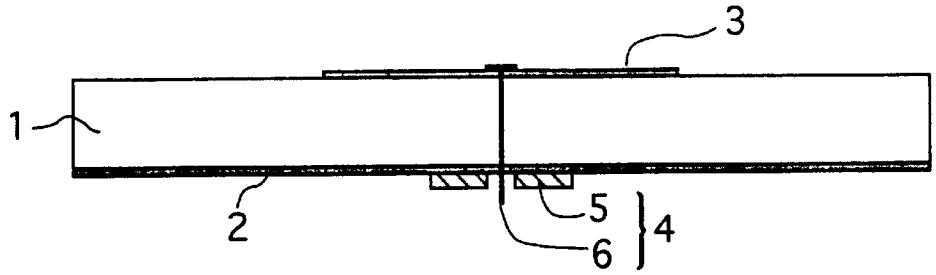
FIG. 1 shows a side view of a traditional antenna fed by coaxial probe.

FIG. 1 shows a side view of a traditional antenna fed by a coaxial probe. The antenna includes;

- a dielectric substrate plate 1, of thickness H=2.28 mm and of relative permittivity $\epsilon_r$=2.2 for example;
- an earth plane 2 constituted by a first conductor layer, for example copper, deposited on a first face of the dielectric substrate plate 1;
- a radiating element 3 constituted by a second conductor layer, for example a copper disc of 73.5 mm diameter, deposited on a second face of the dielectric substrate plate 1; and
- a coaxial probe 4 allowing the antenna to be fed and including an external conductor 5 soldered to the earth plane 2 and an internal conductor 6 soldered to the radiating element 3. The positioning of this coaxial probe 4 allows adaptation of the antenna to be achieved.

The antenna has a fundamental mode, in which it generates a radiation pattern having a maximum in the direction perpendicular to the plane containing the radiating element, and at least one higher mode, in which it generates a radiation pattern with low elevation.

With the dimensions shown previously for the different elements 1, 2, 3 of the antenna, one obtains;

- a resonance frequency F1=1.57 GHz for the fundamental mode TM11;
- a resonance frequency F2=2.63 GHz for the higher mode TM21;
- a resonance frequency F3=3.26 GHz for the higher mode TM01.

Figure 2:
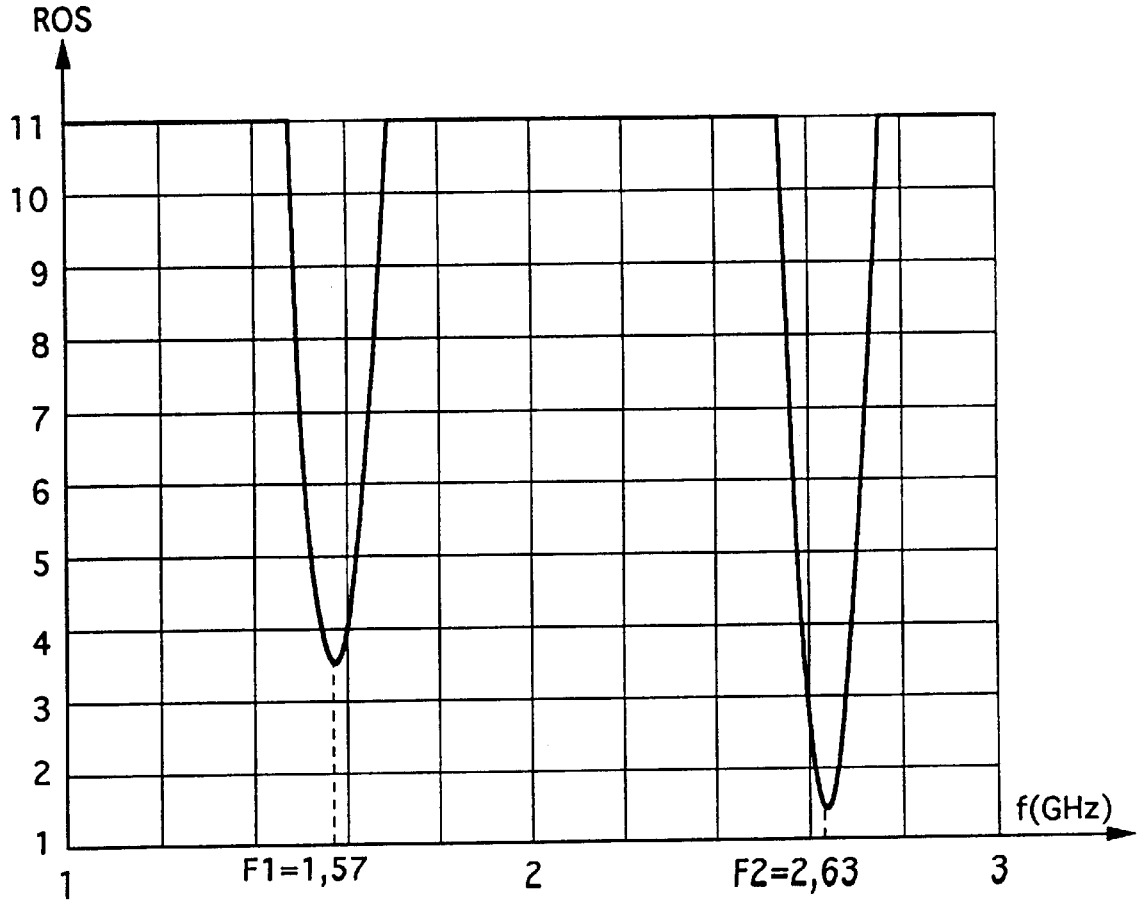
FIG. 2 shows a variation curve, as a function of the frequency of the standing wave ratio (SWR) of the traditional antenna of FIG. 1.

FIG. 2 shows a variation curve, as a function of the frequency of the standing wave ratio (SWR) of the traditional antenna of FIG. 1. This curve shows clearly the resonance frequencies F1 and F2.

According to the invention, the radiating element 3 (that is to say the copper disc in this example) is not whole but has one or several slots that allow one to control the resonance frequency of a chosen higher mode. In the description that follows, there will be shown particularly:

- relating to FIGS. 3 to 11, a first antenna according to the invention, for which the chosen higher mode is the TM21 mode;
- relating to FIGS. 12 to 20, a second antenna according to the invention, for which the chosen higher mode is the TM01 mode.

Figure 3:
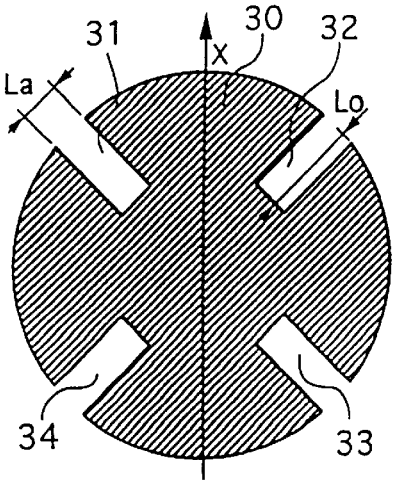
FIG. 3 shows a top view of one embodiment of a first antenna according to the present invention.
Figure 4:
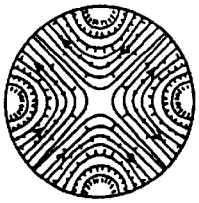
FIG. 4 shows a schematic view of the current lines of the TM21 mode for the first antenna of FIG. 3.

FIG. 3 shows a view from above of the first antenna according to the invention. The radiating element 30 has four radial slots 31 to 34, spaced two by two at angles of about 90°. As is apparent in FIG. 4, for the first antenna of the invention, the current lines of the TM21 mode form a pattern which is repeated on each quarter of the disc (the currents being shown as dotted lines). The slots 31 to 34 are positioned so as to obtain maximum interception of the currents on the radiating element 30. To put it in other terms, each slot is approximately perpendicular to the current lines in one of the quarters of the disc 30.

In this example, the length of the slots Lo=18.375 mm and the width La=7.35 mm. With the intention of optimising these values, they are preferably obtained with the help of a calculation technique (put into practice through software) based on a method of finite elements.

Figure 5:
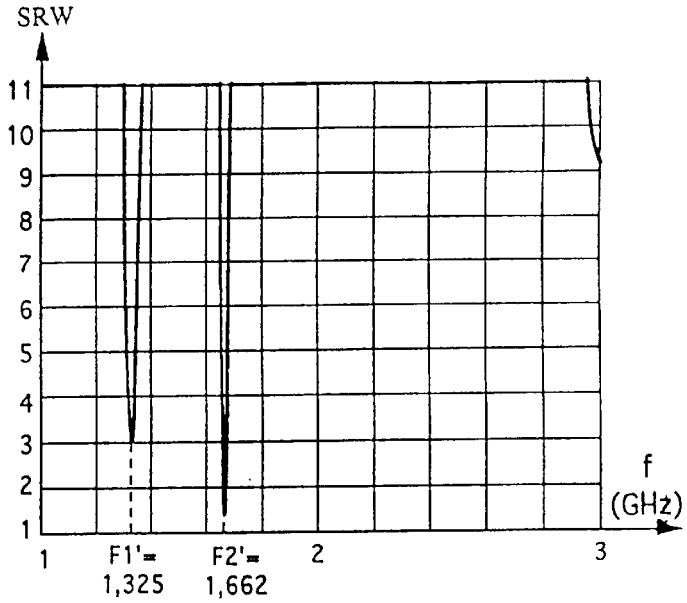
FIG. 5 shows a variation curve as a function of the frequency of the SWR if the first antenna in FIG. 3.

The first antenna has the aim of reducing the resonance frequency of the TM21 higher mode. FIG. 5 shows a variation curve, as a function of the frequency of the SWR of the first antenna of the invention. This FIG. 5 shows clearly that with the help of slots 31 to 34, the resonance frequency of the TM21 higher mode is reduced from F2=2.63 GHz to F2=1.662 GHz. Furthermore, it should be noted that the frequency of the fundamental mode is now situated at F1'=1.325 GHz (instead of 1.57 GHz without the slots).

Therefore the invention permits a considerable reduction in the size of the structure compared with a traditional antenna. In effect, in order to obtain a TM21 mode working at the frequency of 1.662 GHz, a full disc would be necessary having a diameter of approximately 119 mm instead of the diameter of 73.5 mm of the first antenna of the invention. Hence, in this detailed example, the invention allows a reduction in the size of the antenna of about 40%.

Figure 6:
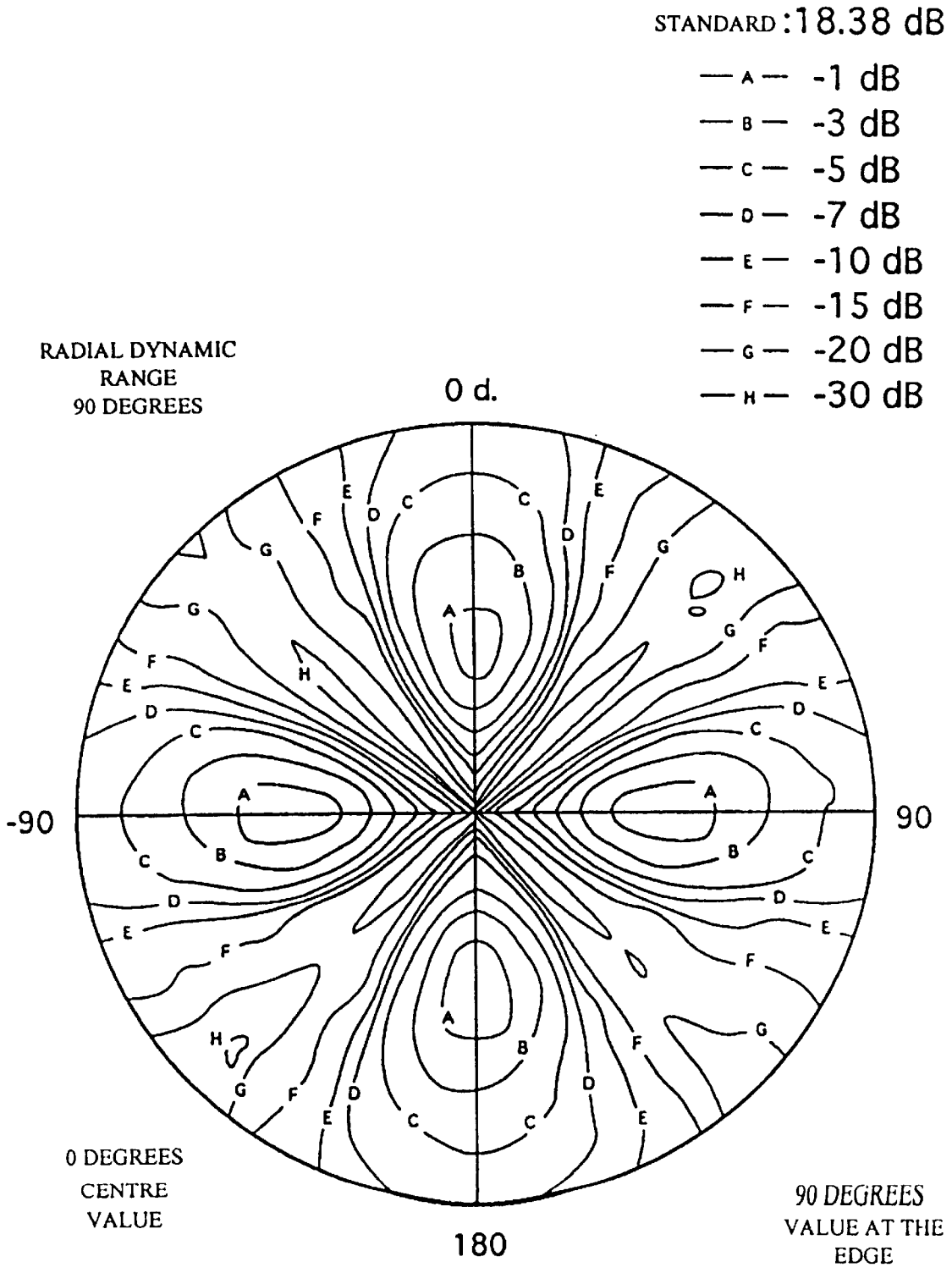
FIG. 6 shows the complete radiation pattern for the Etheta component of the first antenna in FIG. 3.
Figure 7:
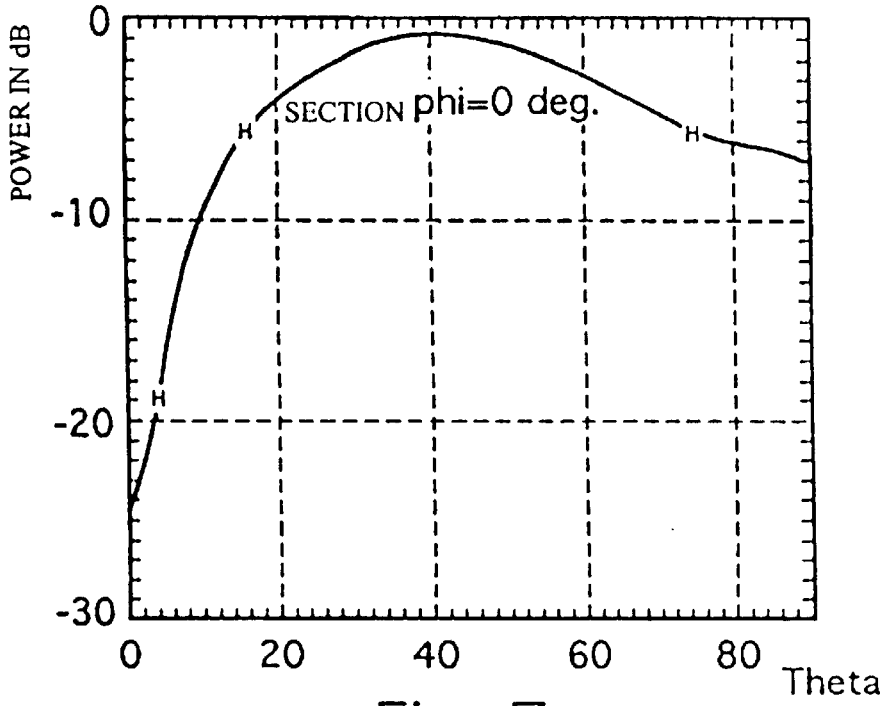
FIGS. 7 and 8 each show a sectional view for phi=0 degrees and 90 degrees respectively, of the radiation pattern of FIG. 6.
Figure 8:
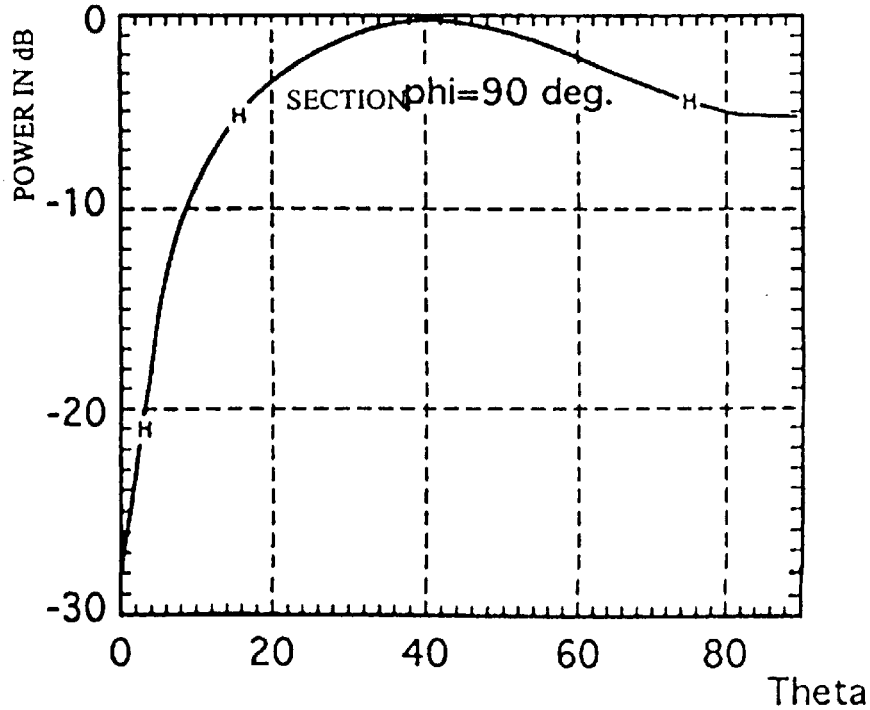
Figure 9:
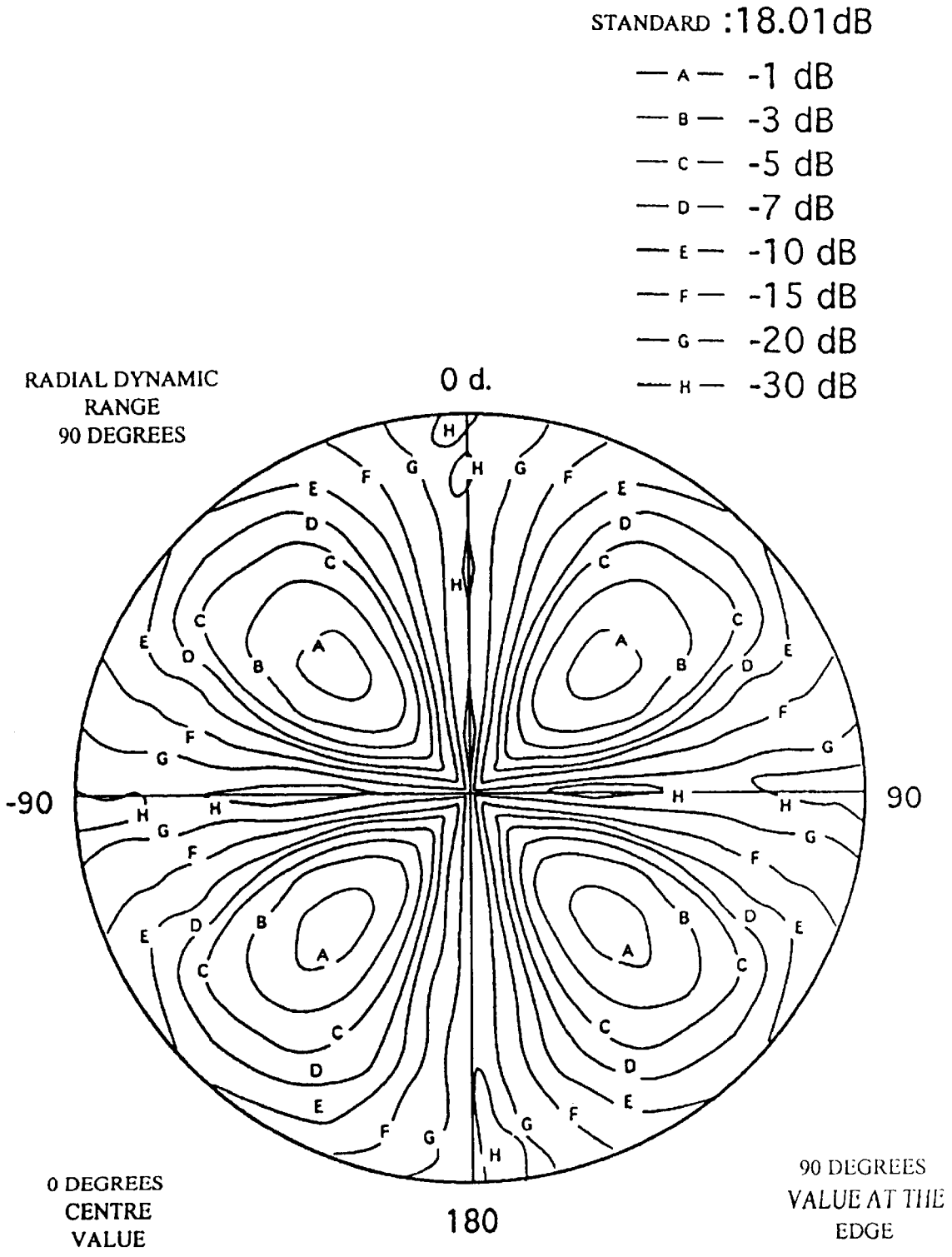
FIG. 9 shows the complete radiation pattern for the Ephi component of the first antenna in FIG. 3.
Figure 10:
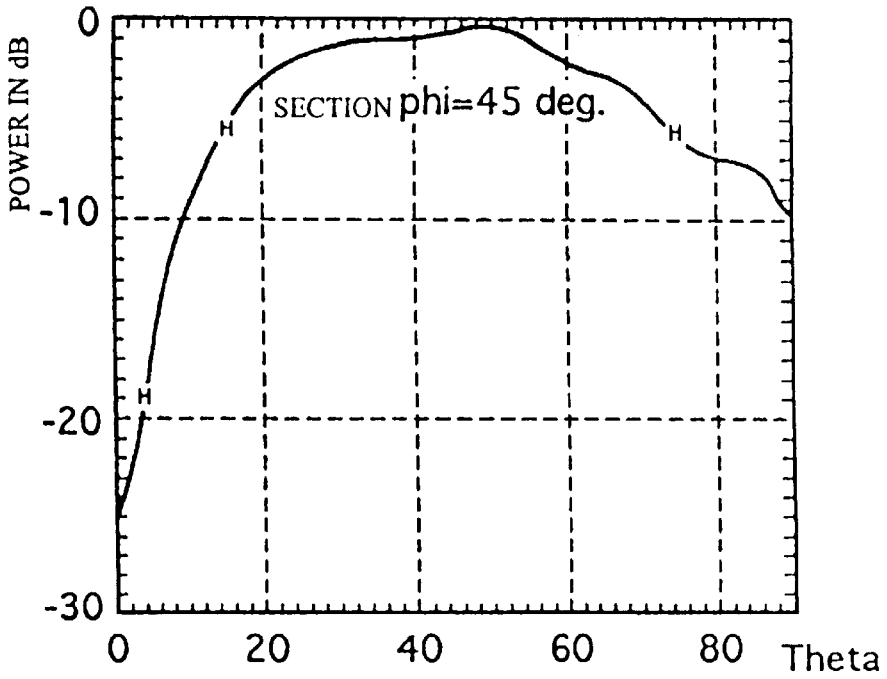
FIGS. 10 and 11 each show a sectional view for phi=45 degrees and 135 degrees respectively, of the radiation pattern of FIG. 9.
Figure 11:
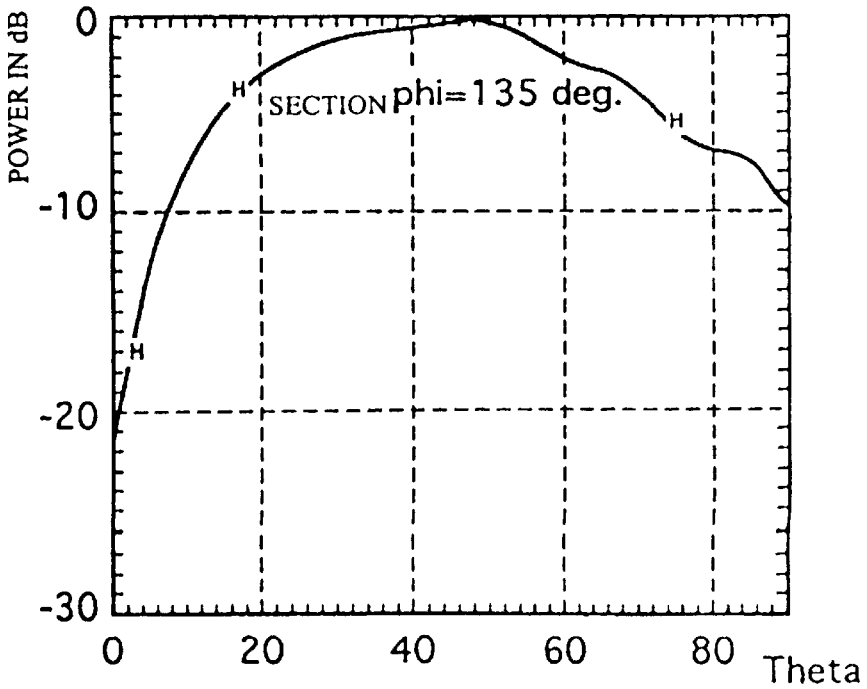

FIGS. 6 and 9 each show the complete radiation pattern, for the Etheta and Ephi components respectively, of the first antenna of the invention. FIGS. 7 and 8 each show a cross section view, for phi=0° and 90° respectively, of the radiation pattern of the Etheta component (FIG. 6). FIGS. 10 and 11 each show a cross section view, for phi=45° and 135° respectively, of the radiation pattern of the Ephi component (FIG. 9).

The radiation patterns have been measured at the resonance frequency of the TM21 mode. So as to be meaningful, the results are shown for the two components Etheta and Ephi (with phi=0 corresponding to the X axis of the antenna (cf. FIG. 3), the Z axis corresponding to the normal to the plane of the antenna.

The radiation patterns are in the shape of "petals", having a maximum situated round about theta=45°, with a spatial rotation phi=45° between the two radiation patterns associated with the two components. The directivity is 5.56 dB. These radiation patterns correspond perfectly to those of a TM21 mode.

Figure 12:
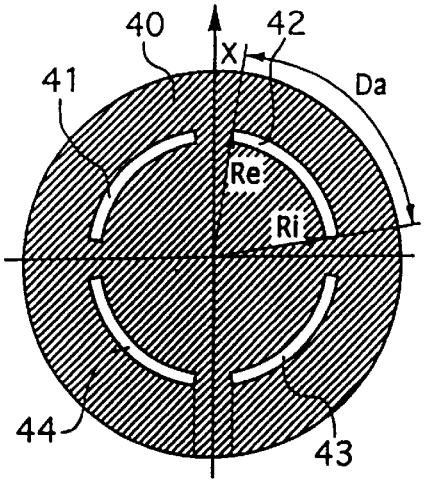
FIG. 12 shows a top view of one embodiment of a second antenna according to the present invention.
Figure 13:
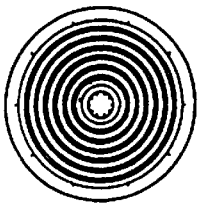
FIG. 13 shows a schematic view of the current lines of the TM01 mode for the second antenna of FIG. 12.

FIG. 12 shows a view from above of the second antenna according to the invention. The radiating element 40 has four circular slots 41 to 44, positioned parallel to the circumference of the disc 40. As is apparent in FIG. 13, for the second antenna of the invention, the current lines of the TM01 mode are circular (the currents, shown as dotted lines, being arranged radially). The slots 41 to 44 are positioned so as to obtain maximum interception of the currents on the radiating element 40. To put it in other terms, each slot is approximately perpendicular to the current lines in one of the four quarters of the disc 40.

In this example, the internal radius of the slots is Ri=23.52 mm, the external radius 25.72 mm and the angular displacement Da=70°. With the intention of optimising these values, they are preferably obtained with the help of the calculation technique, previously mentioned, based on a method of finite elements.

Figure 14:
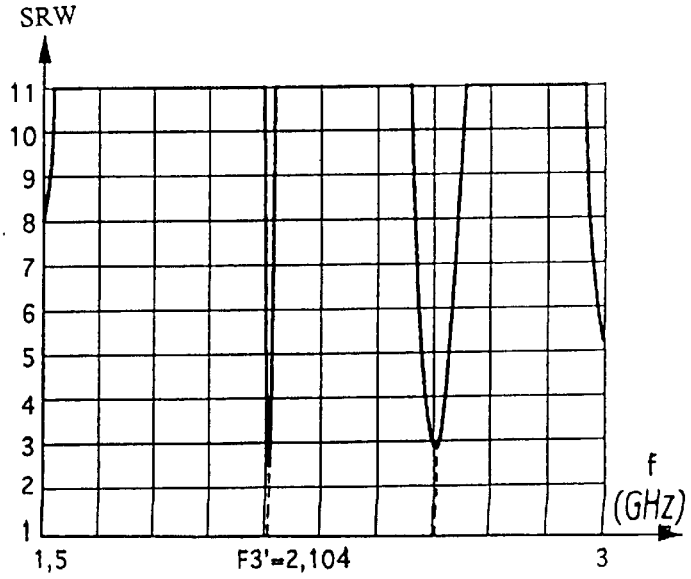
FIG. 14 shows a variation curve as a function of the frequency of the SWR of the second antenna in FIG. 12.

The second antenna has the aim of reducing the resonance frequency of the TM01 higher mode. FIG. 14 shows a variation curve, as a function of the frequency, of the SWR of the second antenna of the invention. This FIG. 14 shows clearly that with the help of slots 41 to 44, the resonance frequency of the TM01 higher mode is reduced from F3=3.26 GHz to F3'=2.104 GHz.

Therefore the invention permits a considerable reduction in the size of the structure compared with a traditional antenna. In effect, in order to obtain a TM01 mode working at the frequency of 2.104 GHz, a full disc would be necessary having a diameter of approximately 117 mm instead of the diameter of 73.5 mm of the second antenna of the invention. Hence, in this detailed example, the invention allows a reduction in the size of the antenna of about 40%.

Figure 15:
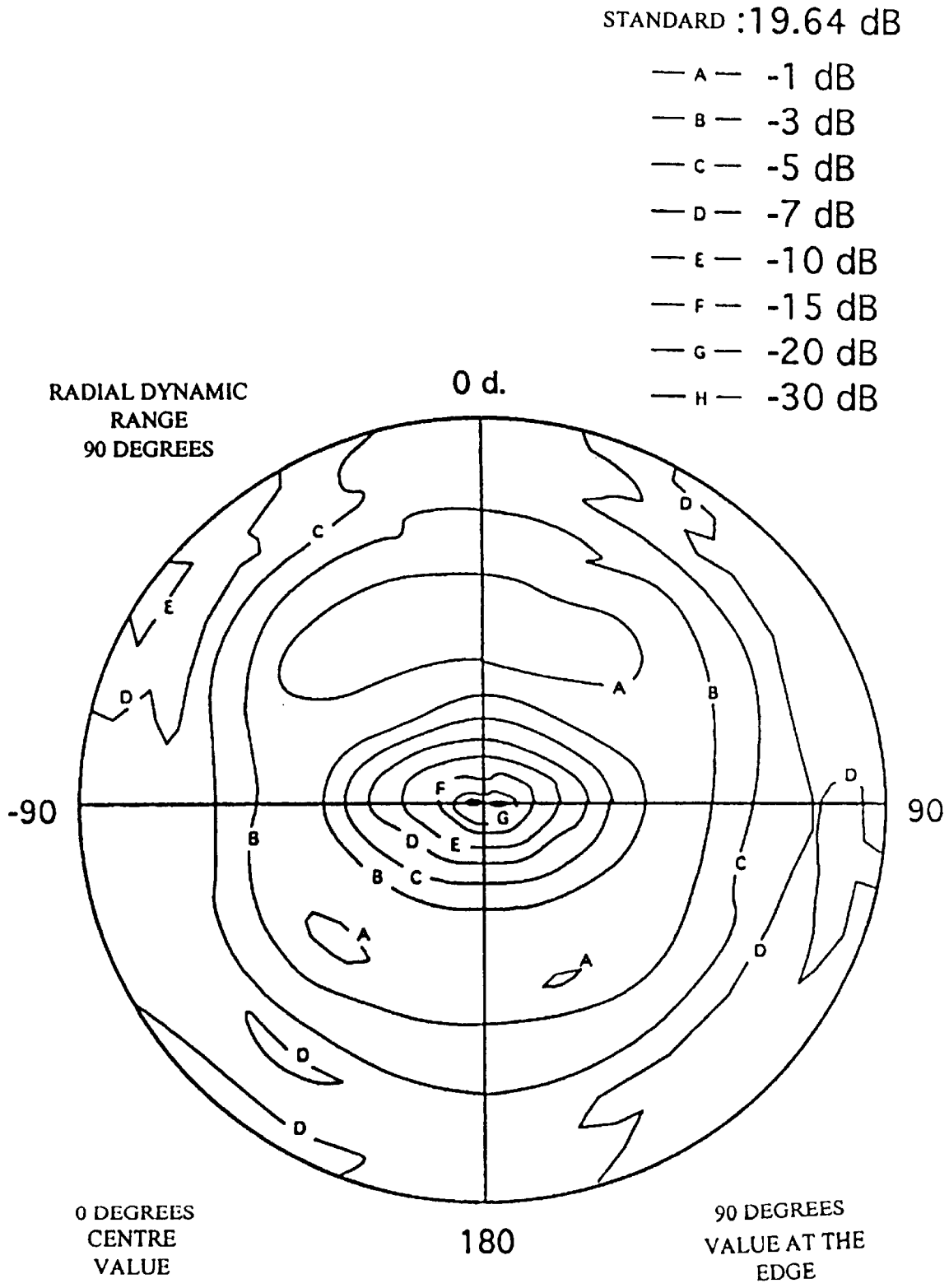
FIG. 15 shows the complete radiation pattern for the Etheta component of the second antenna in FIG. 12.
Figure 16:
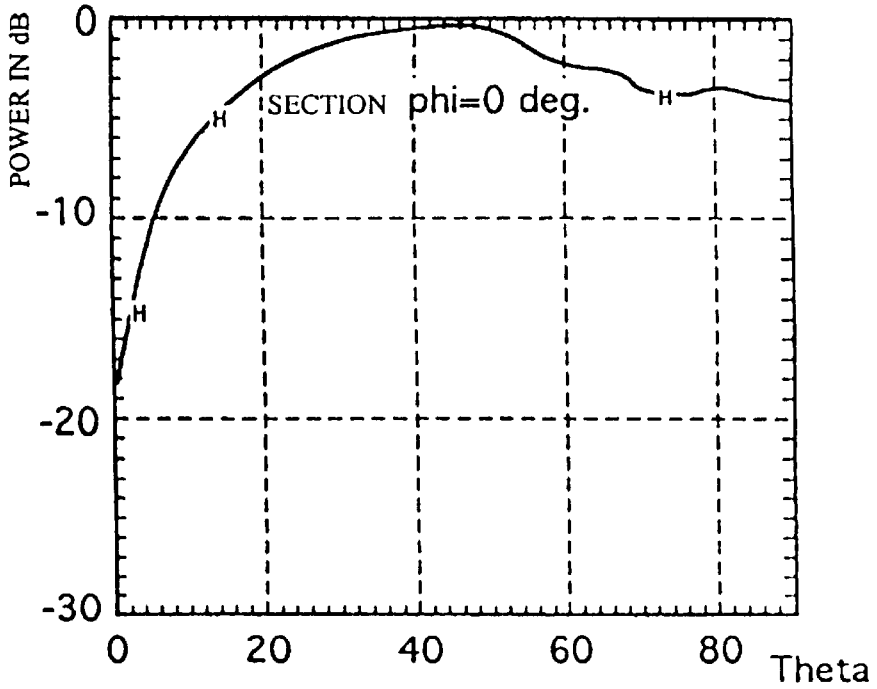
FIGS. 16 and 17 each show a sectional view for phi=0 degrees and 90 degrees, respectively, of the radiation pattern of FIG. 15.
Figure 17:
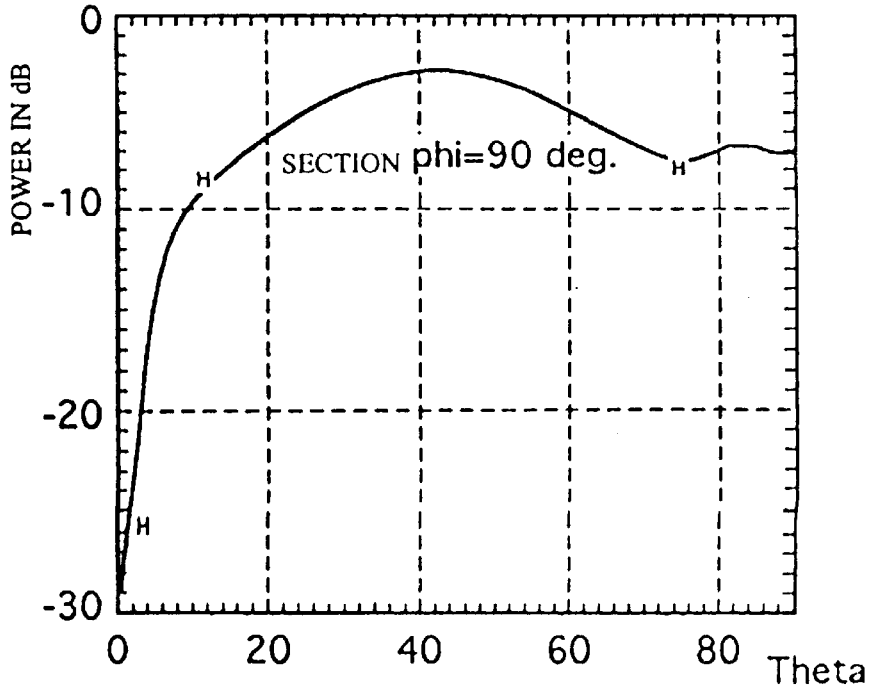
Figure 18:
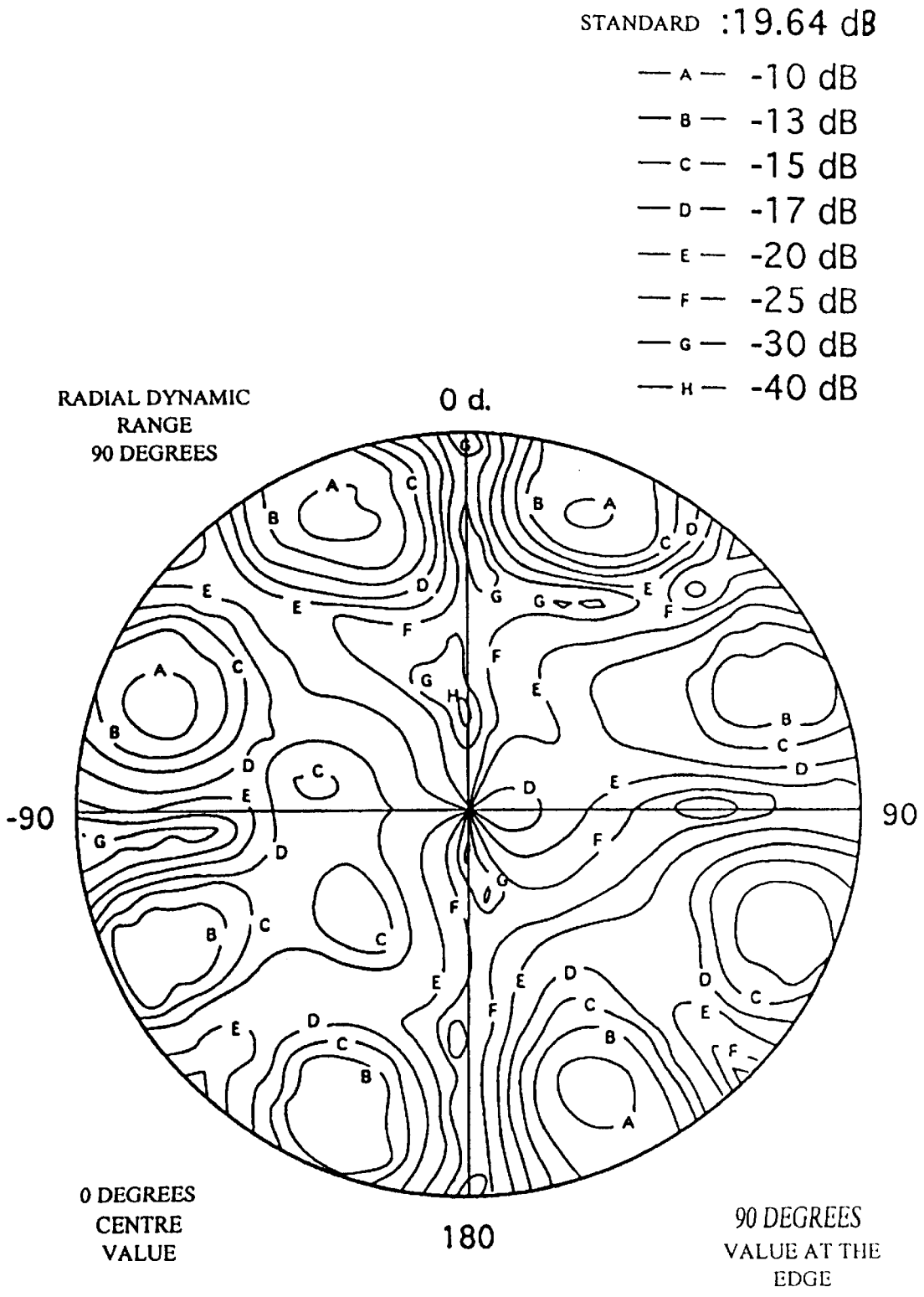
FIG. 18 shows the complete radiation pattern for the Ephi component of the second antenna in FIG. 12.
Figure 19:
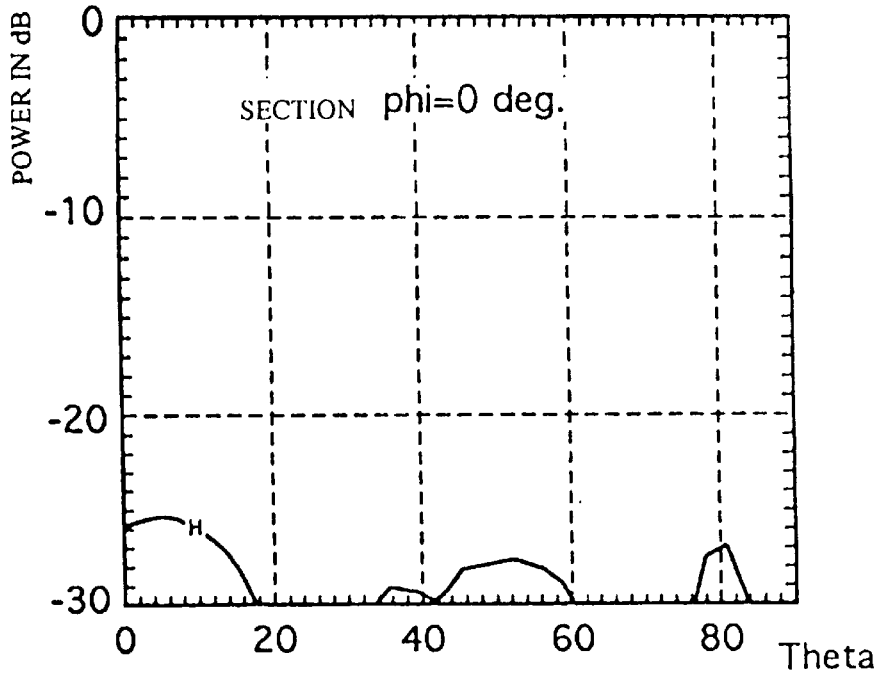
FIGS. 19 and 20 each show a section view for phi=0 degrees and 90 degrees, respectively, of the radiation pattern of FIG. 18.
Figure 20:
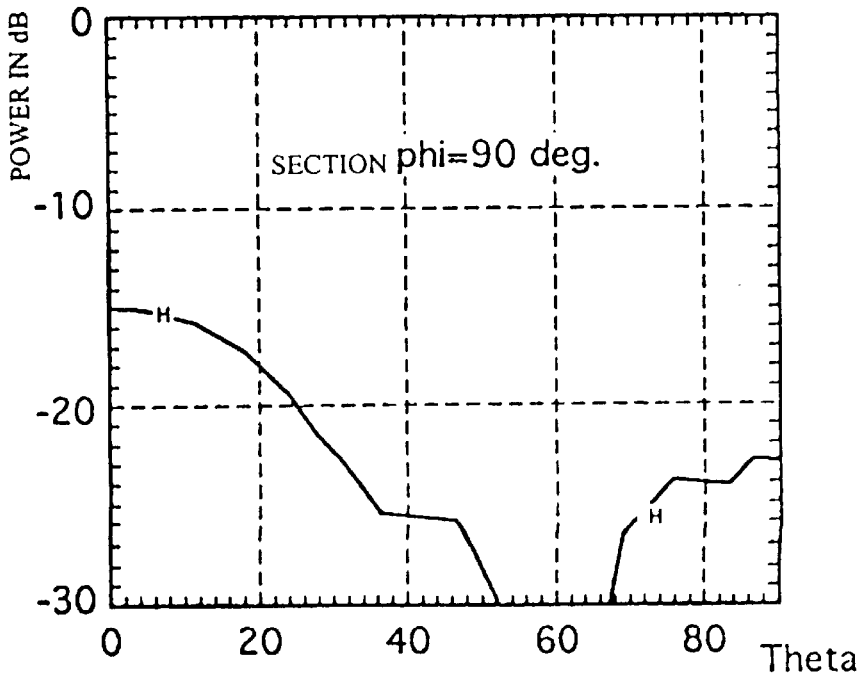

FIGS. 15 and 18 each show the complete radiation pattern, for the Etheta and Ephi components respectively, of the second antenna of the invention. FIGS. 16 and 17 each show a cross section view, for phi=0° and 90° respectively, of the radiation pattern of the Etheta component (FIG. 15). FIGS. 19 and 20 each show a cross section view, for phi=0° and 90° respectively, of the radiation pattern of the Ephi component (FIG. 18).

The radiation patterns have been measured at the resonance frequency of the TM01 mode. The radiation patterns are presented in the same way as those of FIGS. 6 and 9.

It should be noted that the Etheta component is in the shape of a torus having a maximum situated close to theta=45°. The directivity obtained for this antenna is 6.31 dB. These radiation patterns correspond perfectly to those of a TM01 mode.

Figure 21:
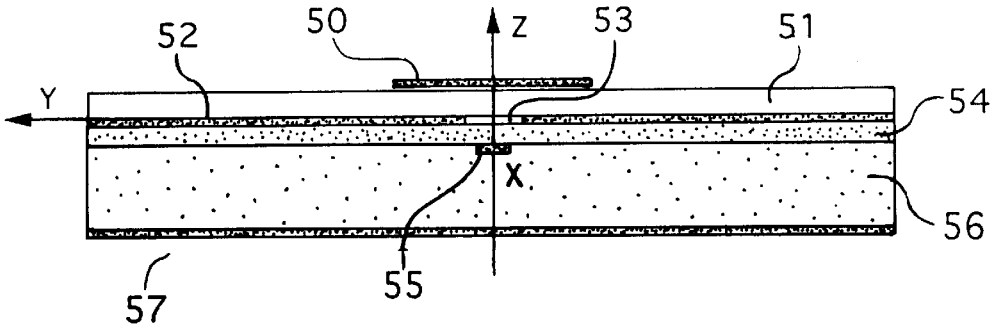
FIGS. 21 and 22 show a side view and a top view, respectively, of an antenna according to the present invention fed by a slit.
Figure 22:
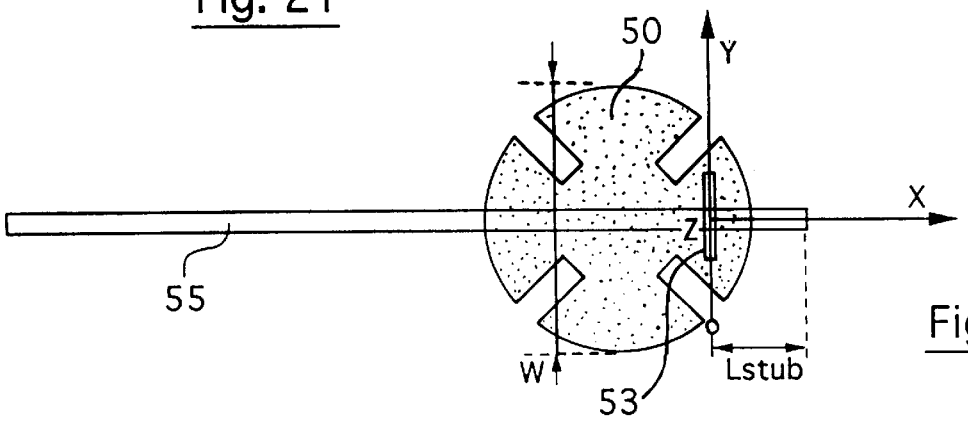

FIGS. 21 and 22 each show a view, respectively from the side and from above of an antenna according to the invention fed by a slit. This antenna includes the following superimposed elements:

- a radiating element 50 of the type shown in FIG. 3 (with four radial slots) and with diameter W;
- a first substrate layer 51, of height H1 and of relative permittivity $\epsilon_{r1}$;
- a first earth plane 52 incorporating a coupling slit 53;
- a second substrate layer 54, of height H2 and of relative permittivity $\epsilon_{r2}$;
- a feed line 55, the end of which extends beyond the slit 53 constitutes a length adaptation stub Lstub;
- a third substrate layer 56, of height H3 and of relative permittivity $\epsilon_{r3}$;
- a second earth plane 57.

Above, two types of feed were mentioned, namely by coaxial probe and by slit coupling. It is clear however that the invention is not limited to these two types of feed but can be used with any type of traditional feed (proximity coupling, feed line in the plane of the radiating element etc.).

Figure 23:
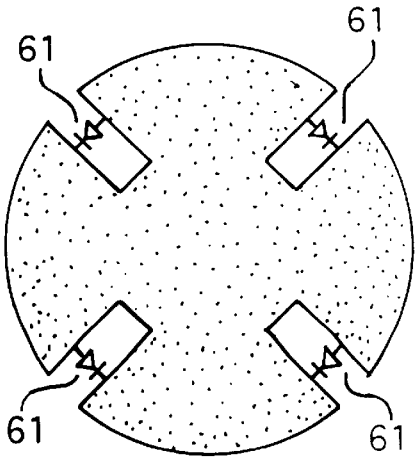
FIG. 23 shows a top view of one particular embodiment of an antenna according to the present invention that includes means of disabling the effect of each slot.

FIG. 23 shows a view from above of a particular embodiment on an antenna according to the invention, in which each slot works with means 61 for disabling its effect. The antenna also includes activation/deactivation means for these disabling means 61. The activation/deactivation means (not shown) are, for example, an electronic command device. In the example shown, the means of disabling the effect of a slot include a varactor diode 61 linking the two edges of that slot.

Hence with supplementary means, one can envisage other types of operation of the antenna of the invention, and particularly a multimode operation and a multifrequency operation.

In multimode operation, the activation/deactivation means act simultaneously on all the diodes, so that:

when all the diodes are activated, the antenna operates in the fundamental mode (having a radiation maximum perpendicular to the antenna), when all the diodes are deactivated, the antenna operates in a chosen higher mode (having a radiation maximum at a low elevation).

In multifrequency operation for a chosen higher mode, the activation/deactivation means act on a number of diodes, variable in time, in a way that each distinct number of diodes activated at a given instant corresponds to a particular resonance frequency of the chosen higher mode.

Figure 24:
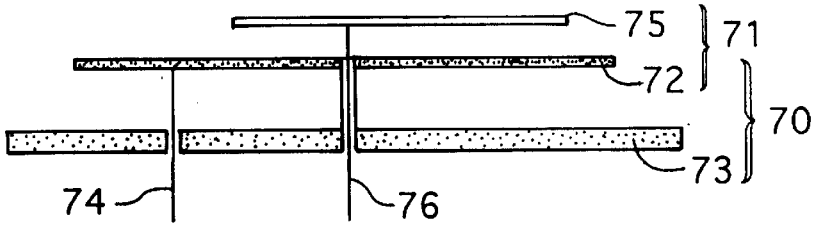
FIGS. 24 and 25 show a side view and a top view, respectively, of a particular embodiment of a two band antenna according to the present invention.
Figure 25:
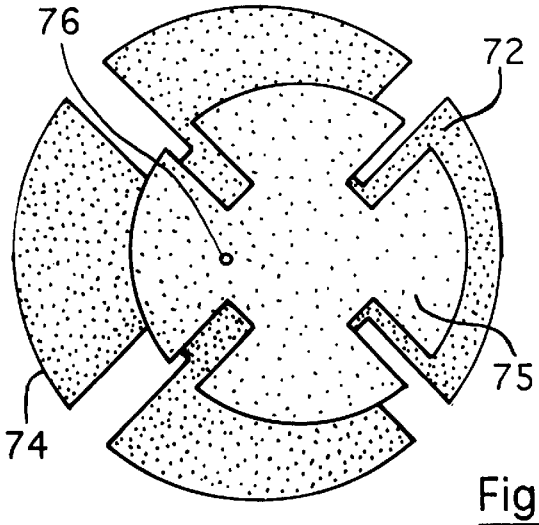

FIGS. 24 and 25 each show a view, respectively from the side and from above of a particular embodiment of a two band antenna according to the invention.

This two band antenna includes two superimposed antennae (lower 70 and upper 71). The radiating element (for example a disc) 72 of the lower antenna 71 constitutes the earth plane of the upper antenna 71.

The lower antenna 70 includes an earth plane 73, a substrate plate (not shown), a radiating element 72 and a first coaxial feed 74. The upper antenna 71 includes an earth plane (constituted by the radiating element 72 of the lower antenna 70), a substrate plate (not shown), a radiating element 75 and a second coaxial feed 76.

Each antenna 70, 71 operates in an independent fashion. The two discs 72, 75 are offset in such a way that the attack of the upper disc 75 passes through the centre of the lower disc in a way that minimise the interference caused.

I claim:

1. A flat printed antenna for transmission and/or reception of microwave signals, the antenna comprising:

a plate of dielectric substrate;

an earth plane formed by a first conductor layer deposited on a first face of said plate of dielectric substrate;

a radiating element formed by a second conductor layer deposited on a second face of said plate of dielectric substrate; and means of feeding said antenna;

said antenna having a fundamental mode, in which it generates a radiation pattern having a maximum in the direction perpendicular to the plane containing the radiating element, and at least one higher mode, in which it generates a radiation pattern at low elevation characterized in that said radiating element has at least one slot allowing the control of the resonance frequency of a chosen higher mode, the at least one slot arranged approximately perpendicular to the current lines of said chosen higher mode.

2. An antenna according to claim 1, wherein the dimensions of the slot or slots are determined from a calculation technique based on a finite elements method.

3. A flat printed antenna for transmission and/or reception of microwave signals, the antenna comprising:

a plate of dielectric substrate;

an earth plane formed by a first conductor layer deposited on a first face of said plate of dielectric substrate;

a radiating element formed by a second conductor layer deposited on a second face of said plate of dielectric substrate; and means of feeding said antenna said feeding means using a feed technique belonging to the group that includes:

feed by a coaxial probe;

feed by proximity coupling;

feed through a feed line in the plane of the radiating element; and feed by coupling through slits;

said antenna having a fundamental mode, in which it generates a radiation pattern having a maximum in the direction perpendicular to the plane containing the radiating element, and at least one higher mode, in which it generates a radiation pattern at low elevation, characterized in that said radiating element has at least one slot allowing the control of the resonance frequency of a chosen higher mode.

4. A flat printed antenna for transmission and/or reception of microwave signals, the antenna comprising:

a plate of dielectric substrate;

an earth plane formed by a first conductor layer deposited on a first face of said plate of dielectric substrate;

a radiating element formed by a second conductor layer deposited on a second face of said plate of dielectric substrate, the radiating element being in the form of a disc, said radiating element having four radial slots spaced two by two at angles of about 90 degrees; and means of feeding said antenna;

said antenna having a fundamental mode, in which it generates a radiation pattern having a maximum in the direction perpendicular to the plane containing the radiating element, and at least one higher mode, in which it generates a radiation pattern at low elevation, characterized in that said four radial slots of said radiating element allow the control of the resonance frequency of a chosen higher mode wherein said chosen higher mode is the TM21 mode, whose current lines form a pattern that is repeated in each quarter of said disc, each of said four radial slots being approximately perpendicular to the current lines of one of said disc quarters.

5. A flat printed antenna for transmission and/or reception of microwave signals, the antenna comprising:

a plate of dielectric substrate;

an earth plane formed by a first conductor layer deposited on a first face of said plate of dielectric substrate;

a radiating element formed by a second conductor layer deposited on a second face of said plate of dielectric substrate, the radiating element being in the form of a disc, said radiating element having at least one circular slot extending over at least a part of the circumference of a circle contained within said disc and disposed concentric therewith; and means of feeding said antenna;

said antenna having a fundamental mode, in which it generates a radiation pattern having a maximum in the direction perpendicular to the plane containing the radiating element, and at least one higher mode in which it generates a radiation pattern at low elevation, characterized in that said radiating element has at least one slot allowing the control of the resonance frequency of a chosen higher mode wherein said chosen higher mode is the TM01 mode, the current lines from which are arranged radially.

6. A flat printed antenna for transmission and/or reception of microwave signals, the antenna comprising:

a plate of dielectric substrate;

an earth plane formed by a first conductor layer deposited on a first face of said plate of dielectric substrate;

a radiating element formed by a second conductor layer deposited on a second face of said plate of dielectric substrate; and means of feeding said antenna;

said antenna having a fundamental mode, in which it generates a radiation pattern having a maximum in the direction perpendicular to the plane containing the radiating element, and at least one higher mode, in which it generates a radiation pattern at low elevation, characterized in that said radiating element has at least one slot allowing the control of the resonance frequency of a chosen higher mode, each of said at least one slot having disabling means, and wherein the antenna includes activation/deactivation means for activating and deactivating said disabling means.

7. An antenna according to claim 6, wherein said means of disabling the effect of a slot include a diode connected to two edges of said slot.

8. An antenna according to claim 6, wherein said radiating element has a plurality of slots, and wherein said activation/deactivation means act simultaneously on all the disabling means associated with said plurality of slots, in a way that allows multimode operation such that:

when all the disabling means are activated, the antenna operates in said fundamental mode; and when all the disabling means are deactivated, the antenna operates in said chosen higher mode.

9. An antenna according to claim 6, wherein said radiating element has a plurality of slots, and wherein said activation/deactivation means act on a number, that is variable in time, of disabling means associated with said plurality of slots, in a way that permits multifrequency operation such that each distinct number of disabling means activated at a given instant corresponds to a particular resonance frequency of said chosen higher mode.

10. A two band antenna comprising: a lower antenna and an upper antenna superimposed thereon, each antenna comprising:

a plate of dielectric substrate;

an earth plane formed by a first conductor layer deposited on a first face of said plate of dielectric substrate;

a radiating element formed by a second conductor layer deposited on a second face of said plate of dielectric substrate; and means of feeding said antenna;

said antenna having a fundamental mode, in which it generates a radiation pattern having a maximum in the direction perpendicular to the plane containing the radiating element, and at least one higher mode in which it generates a radiation pattern at low elevation, characterized in that said radiating element has at least one slot allowing the control of the resonance frequency of a chosen higher mode, wherein the radiating element of said lower antenna forms the earth plane of said upper antenna.

11. An antenna according to claim 1 wherein said feeding means uses a feed technique selected from the group consisting of:

feed by a coaxial probe;

feed by coupling through slits;

feed by proximity coupling; and feed through a feed line in the plane of the radiating element.

12. An antenna according to claim 1 wherein said radiating element is in the form of a disc.

13. An antenna according to claim 1 wherein said chosen higher mode is the TM21 mode, whose current lines form a pattern that is repeated in each quarter of said disc, and further wherein said radiating element has four radial slots spaced two by two at angles of about 90 degrees, each of said slots being approximately perpendicular to the current lines of one of said disc quarters.

14. An antenna according to claim 1 wherein said chosen higher mode is the TM01 mode, the current lines from which are arranged radially, and further wherein said radiating element has at least one circular slot, the at least one circular slot extending over at least a part of the circumference of a circle contained within said disc and disposed concentrically therewith.

15. An antenna according to claim 1 wherein each slot works with means of disabling its effect, and further wherein the antenna includes activation/deactivation means for activating and deactivating said disabling means.

16. An antenna according to claim 15 wherein said means of disabling the effect of a slot includes a diode connected to two edges of said slot.

17. An antenna according to claim 15 wherein said radiating element has a plurality of slots, and further wherein said activation/deactivation means acts simultaneously on all the disabling means associated with said plurality of slots, in a way that allows multimode operation such that:

when all the disabling means are activated, the antenna operates in said fundamental mode; and when all the disabling means are deactivated, the antenna operates in said chosen higher mode.

18. An antenna according to claim 15 wherein said radiating element has a plurality of slots, and further wherein said activation/deactivation means acts on a number, that is variable in time, of disabling means associated with said plurality of slots, in a way that permits multifrequency operation such that each distinct number of disabling means activated at a given instant corresponds to a particular resonance frequency of said chosen higher mode.

19. A two band antenna, characterized in that it includes two superimposed antennae, called lower and upper antennae, according to claim 1, the radiating element of said lower antenna forming the earth plane of said upper antenna.

* * * * *